United States Patent [19]

Nakao

[11] 4,320,482

[45] Mar. 16, 1982

[54] SWITCH FOR AN ELECTRONIC TIMEPIECE

[75] Inventor: Hideyuki Nakao, Tokyo, Japan

[73] Assignee: Kabushiki Kaisha Daini Seikosha, Tokyo, Japan

[21] Appl. No.: 227,726

[22] Filed: Jan. 23, 1981

Related U.S. Application Data

[63] Continuation of Ser. No. 50,126, Jun. 19, 1979, abandoned.

[30] Foreign Application Priority Data

Jun. 27, 1978 [JP] Japan ..... 53-77613

[51] Int. Cl.[3] ..... G04B 17/12; G04B 29/00

[52] U.S. Cl. ..... 368/201; 368/321

[58] Field of Search ..... 368/69–70, 368/85–87, 155–157, 159, 160, 187–188, 200–202, 320–321; 200/11 G, 11 J, 11 K

[56] References Cited

U.S. PATENT DOCUMENTS

| | | | |
|---|---|---|---|
| 3,733,803 | 5/1973 | Hiraga et al. | 368/201 X |
| 3,812,669 | 5/1974 | Wiget | 368/201 |
| 3,869,586 | 3/1975 | Patz et al. | 200/11 G |
| 4,020,626 | 5/1977 | Kunabara et al. | 368/156 |

*Primary Examiner*—Vit W. Miska

*Attorney, Agent, or Firm*—Robert E. Burns; Emmanuel J. Lobato; Bruce L. Adams

[57] ABSTRACT

A plurality of mechanical switches in an electronic timepiece having a timepiece circuit which performs frequency division and which has a plurality of terminals for controlling frequency division within the timepiece circuit according to external connections made to the plurality of terminals. The plurality of mechanical switches includes at least one rotary switch. The plurality of mechanical switches is connected to the timepiece circuit terminals for making a number of different external connections to the terminals which exceeds the sum of the different possible switch settings of the respective individual switches of the plurality of mechanical switches.

3 Claims, 6 Drawing Figures

SWITCH FOR AN ELECTRONIC TIMEPIECE

This is a continuation of application Ser. No. 50,126, filed June 19, 1979, and now abandoned.

BACKGROUND OF THE INVENTION

The present invention relates to a rotary switch of an electronic timepiece. Recently electronic timepieces have become highly developed, and especially techniques used for realizing a quartz crystal timepiece have remarkably advanced by development of the timepiece integrated circuit (IC). In a quartz crystal timepiece, a motor is driven by frequency divided signals produced from a quartz oscillator.

Conventionally, frequencies of a quartz crystal have been determined according to a fixed frequency dividing ratio and thereby a trimmer condenser have been used as a step regulator. However, as for this method, current consumption is varied by a capacitance variation of the trimmer condenser caused by temperature variation, and therefore a current value of an oscillating circuit is set accounting for the current variation.

Attendant on recent prolongation of the lifetime of the quartz crystal timepiece, it has become necessary to decrease the current consumption of timepiece IC and if the trimmer condenser is used for regulating frequency in steps, it is necessary to set the current consumption at a high value in the normal state when the current value of the oscillating circuit is set, so that the oscillating circuit can be operated normally even if the capacity of the trimmer condenser varied. Accordingly it is difficult to decrease the current consumption. Further, in the conventional fixed frequency division, the frequency of the quartz crystal vibrator is tuned with the frequency set according to the frequency dividing ratio and the available percentage of the quartz crystal frequency having a narrow regulating range is decreased. For the quartz crystal having a narrow regulating range, the variable frequency division technique has been adopted. In this case, the switch to tune the frequency dividing ratio of the timepiece IC is necessary and the "teeth of a comb" shaped switch plated as shown in FIG. 1 was invented. In this case, however, it was necessary to tune the frequency by changing the "teeth of the comb" of the switch plate according to each of possible combinations and to complete every combination and further to prepare a number of shapes for prior assembling. When the switch plate was changed it was troublesome to remove the switch plate and also it was necessary to prepare every part for subsequent service when the timepiece was adjusted after marketing. In the manufacturing process, four pieces of the "teeth of the comb" shaped switch plates should be punched out before cutting each of the teeth and to manufacture 15 kinds of switch plates if every one of the switch plates were provided with four terminals.

Accordingly, it is an object of the present invention to provide a variable frequency dividing switch a wide adjustable range and easily adjustable by arranging more than two rotary switches having a couple of input terminals on a circuit block.

DESCRIPTION OF THE PREFERRED EMBODIMENTS

Figure 1:
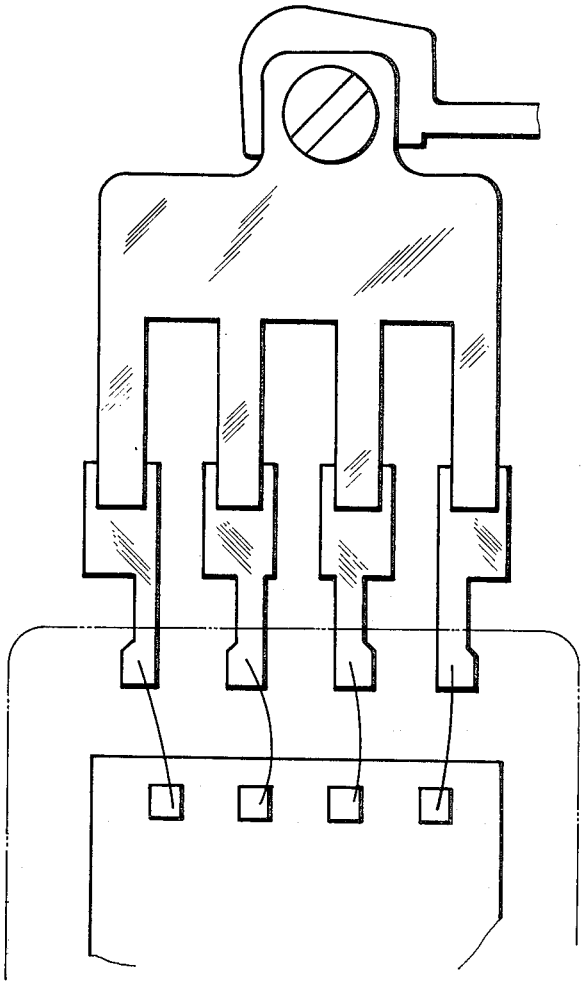
FIG. 1 PRIOR ART
FIG. 1 shows a conventional switch construction.
Figure 2:
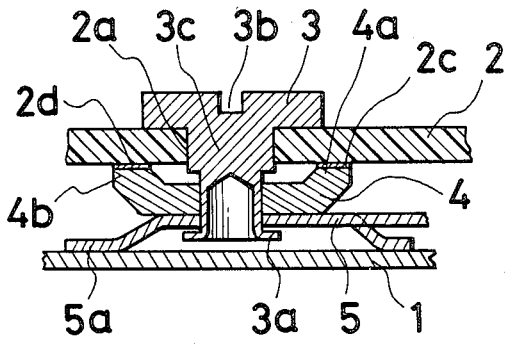
FIG. 2 is an embodiment of the present invention showing a sectional view of a switch.
Figure 3:
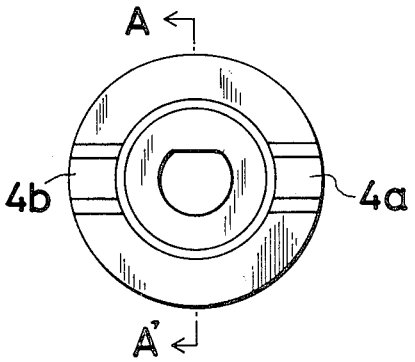
FIG. 3 is a plan view showing a rotor of the switch in the direction of the circuit board 2.
Figure 4:
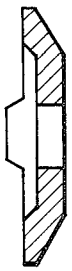
FIG. 4 is a section taken on line A—A′ in FIG. 3.

Referring now to an embodiment of the present invention, the construction of the present invention will be illustrated in conjunction with FIGS. 2, 3 and 4.

In FIG. 2 a base plate 1 is opposite a circuit board 2 provided with circuit patterns 2*c* and 2*d* composing switch terminals. Two projections 4*a*, 4*b* of a rotor 4 composed of an elastic conductor contact with the patterns 2*c* and 2*d*. The rotor 4 may be molded resin and plated. An elastic member 5 is rotatably fixed together with a drive pin 3, provided with a slot 3*b*, by a caulking portion 3*a* of the drive pin 3.

When the circuit board 2 is fixed to the screw pin of a base plate 1 not shown, the projection 4*a* of a rotor 4 and the pattern 2*c*, and the projection 4*b* and the pattern 2*d* contact by elasticity.

FIG. 3 shows a plan view of the rotor 4 and FIG. 4 shows a section taken on line A—A′ in FIG. 3.

Figure 5:
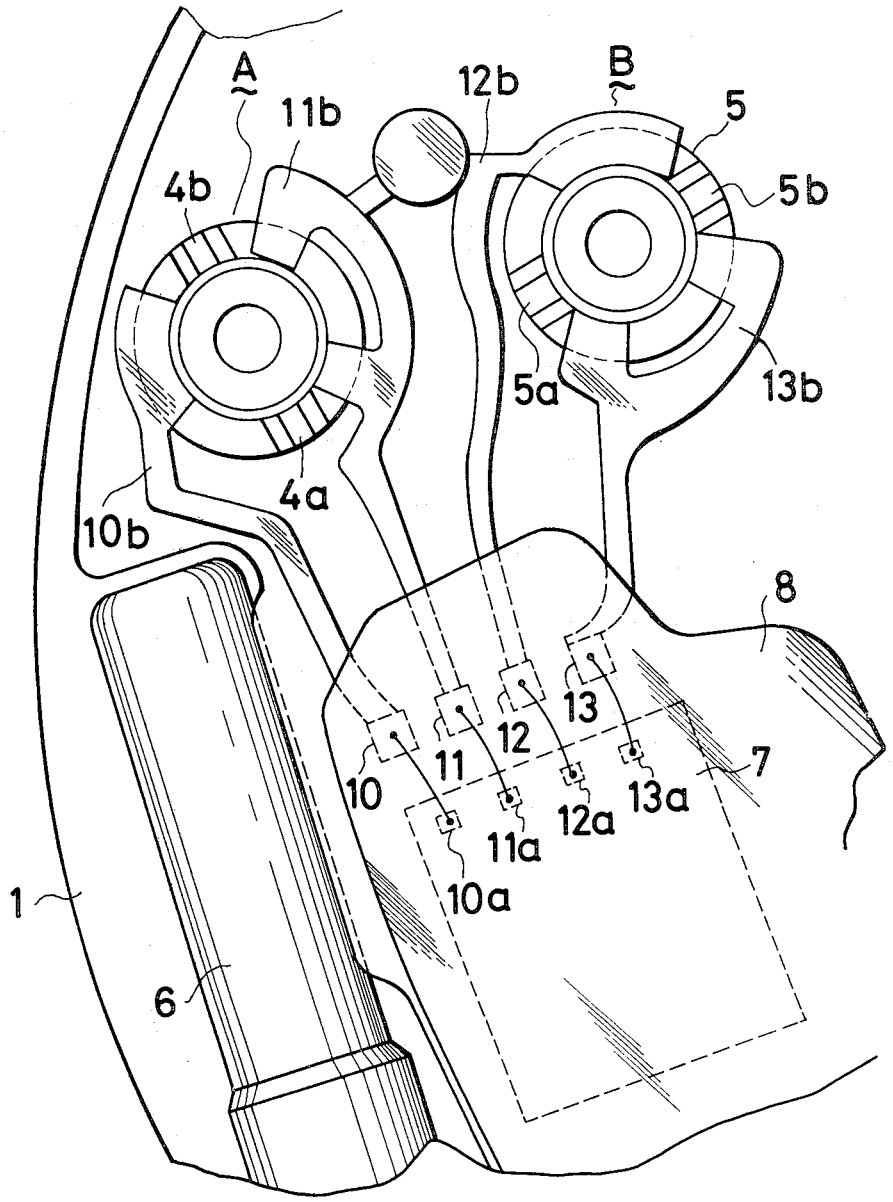
FIG. 5 is a plan view showing a switch mounted on a circuit block.

Referring then to FIG. 5 showing the rotary switch mounted on a circuit block 7. Numeral 1 is a base plate and numeral 6 is a quartz crystal vibrator composing a circuit block. Numeral 7 is an IC provided with variable frequency dividing terminals 10*a*, 11*a*, 12*a* and 13*a* which are wire bonded to patterns 10, 11, 12 and 13. Numeral 8 is a transfer molded resin to mount the IC thereon.

Referring to the operation of the switch in conjunction with FIG. 5, in case the rotor 4 is electrically in contact with the base plate 1 by section 5*a* of the elastic member 5 shown in FIG. 3, the switch is in state "O" when the patterns 10*b*, 11*b* and 4*a*, 4*b* of the rotor 4, the patterns 12*b*, 13*b* and 5*a*, 5*b* of the rotor 5 do not contact. If the switch is provided with two input terminals as shown in FIG. 5, the operation of the switch has four combinations as shown in Table 1.

TABLE 1

| | |
|---|---|
| 0 | 0 |
| 0 | 1 |
| 1 | 0 |
| 1 | 1 |

Moreover, if there are two switches the operation of the switch has sixteen combinations as shown in Table 2 below. When the switch B rotates in the case that the switch A is in the "00" state, the projection 5*b* contacts with the primary pattern of the pattern 13*b* while the projection 5*a* doesn't contact with any pattern, and the switch is in a state "2" shown in Table 2. If the switch B rotates more, the projection 5*b* doesn't contact with a pattern and the projection 5*a* contacts with the pattern 12*b* in place and the switch is in a state "3" shown in Table 2. If the switch B rotates further, the projection 5*b* contacts with the other side of the pattern 13*b* again and since the projection 5*a* is in the same state as "3" in Table 2, the switch is in a state "4" in Table 2. When the switch A rotates further, the projection 4*b* contacts with the pattern 11*b* while the projection 4*a* doesn't contact a pattern. If the switch B is restored to the position shown by a solid line in FIG. 5, it is in a state "5" in Table 2. If the switch B is rotated after the switch A is rotated as mentioned above, the switch is in a state "8" in Table 2. If the switch A is rotated in turn and the switch B is operated as mentioned before, sixteen combinations as shown by Table 2 are possible.

Figure 6:
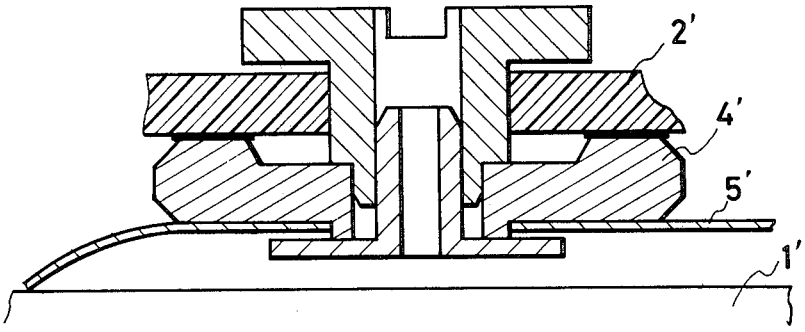
FIG. 6 is a sectional view showing another embodiment of the present invention.

In case the elastic member 5 is made of a thin plate in view of the switch construction, if the pin indentation system is adopted as shown in FIG. 6, the deformation of the elastic member caused by calking is prevented.

TABLE 2

| | |
|---|---|
| 1 ..... 0 0 0 0 | 9 ..... 1 0 0 0 |
| 2 ..... 0 0 0 1 | 10 ..... 1 0 0 1 |
| 3 ..... 0 0 1 0 | 11 ..... 1 0 1 0 |
| 4 ..... 0 0 1 1 | 12 ..... 1 0 1 1 |
| 5 ..... 0 1 0 0 | 13 ..... 1 1 0 0 |
| 6 ..... 0 1 0 1 | 14 ..... 1 1 0 1 |
| 7 ..... 0 1 1 0 | 15 ..... 1 1 1 0 |
| 8 ..... 0 1 1 1 | 16 ..... 1 1 1 1 |

As illustrated, since the step regulating switch is a rotatory system according to the present invention, an assembling process is simplified and a supply of step regulating parts for service becomes unnecessary. Further, the assembly becomes easy because of the simple switch construction. Moreover, with four combinations for each of switches, the rotation angle of the rotor can be divided every 90 degrees and the switch position adjustment steps can be spaced equally every 90 degrees within the range the switches are used.

I claim:

1. In an electronic timepiece: a circuit board; an integrated electronic timepiece circuit on said circuit board and which performs frequency division, said timepiece circuit having a plurality of terminals for controlling frequency division within said timepiece circuit according to external connections made to said terminals; a base plate opposite said circuit board; means comprised of a plurality of mechanical switches including at least one rotary switch connected to said terminals for making a number of different external connections to said terminals which exceeds the sum of the different possible switch settings of the respective individual switches of said plurality of mechanical switches, wherein said rotary switch is comprised o a conductive rotor having at least a pair of projections facing said circuit board, a driving member fixed to said conductive rotor and mounting said conductive rotor on said circuit board for rotation with said projections contacting said circuit board, said driving member having a slot or non-circuit hole therein to facilitate rotation of said driving member for rotating said rotor, and circuit patterns on said circuit board for defining switch contacts and positioned for contacting said projections of said conductive rotor when said conductive rotor is rotated to certain positions, wherein the respective ones of said switch contacts contacted by said projections of said rotor are determined by the position of said rotor and are changeable by rotation of said rotor, and an elastic member between said rotor and said base plate for urging said conductive rotor against said circuit board to keep said conductive rotor projections in contact with said switch contacts on said circuit board; and means electrically connecting said circuit patterns to respective ones of said timepiece circuit terminals for changing the external connections to said terminals by rotation of said conductive rotor.

2. In an electronic timepiece according to claim 1: said conductive rotor comprising a disc-shaped body having a pair of major surfaces and said pair of projections extending from one of said pair of major surfaces facing said circuit board.

3. In an electronic timepiece according to claim 1: wherein said conductive rotor has a central non-circular hole therethrough extending between said pair of major surfaces of said conductive rotor; said circuit board has a hole therethrough opposite and aligned with the central non-circular hole through said conductive rotor; and said driving member is comprised of a shaft portion extending through the hole through said circuit board for rotation and having a non-circular portion shaped for being received by the non-circular hole through said conductive rotor and extending through said conductive rotor for rotating said conductive rotor upon rotation of said driving member in the hole through said circuit board, and head portion at an end of said shaft portion that extends through said circuit board and having a diameter larger than the hole through said circuit board, and a flange portion at a second end of said shaft portion extending through said conductive rotor and having a diameter larger than the non-circular hole through said conductive rotor.

* * * * *